United States Patent [19]

Hardesty et al.

[11] Patent Number: 4,459,762

[45] Date of Patent: Jul. 17, 1984

[54] SOLVENT DEWATERING COAL

[75] Inventors: Donald E. Hardesty, Brookshire; Herbert F. Buchholz, Sugar Land, both of Tex.

[73] Assignee: Shell Oil Company, Houston, Tex.

[21] Appl. No.: 442,559

[22] Filed: Nov. 18, 1982

[51] Int. Cl.[3] ..... F26B 3/00; C10L 5/00

[52] U.S. Cl. ..... 34/9

[58] Field of Search ..... 34/9; 44/10 E, 10 J

[56] References Cited

U.S. PATENT DOCUMENTS 3,327,402 6/1967 Lamb et al. ..... 34/9

3,953,927 5/1976 Hoffert ..... 34/9

4,235,603 11/1980 Miller et al. ..... 44/10 E

*Primary Examiner*—John J. Camby

[57] ABSTRACT

Drying of wet coal is facilitated by the addition of a nonaqueous solvent, such as acetone, to the coal followed by application of heat to remove both solvent and water from the coal. The coal may be further upgraded by briquetting or pelletizing fine coal particles with waxes and resins extracted from the coal, or the waxes and resins may be left on the coal to reduce the tendency of the coal to reabsorb water. In addition, minerals such as sodium and potassium salts may be removed from the coal to reduce slagging and fouling behavior of the coal.

14 Claims, No Drawings

SOLVENT DEWATERING COAL

BACKGROUND OF THE INVENTION

This invention relates to drying particulate carbonaceous materials such as coal, lignite and the like. More particularly, this invention relates to a process for removing water from particulate carbonaceous material by a method which reduces the amount of heat required to obtain a given degree of dryness. Also, the coal may be otherwise upgraded by improving its dusting, waterproofing characteristics and its resistance to spontaneous combustion. Dust washed from the coal may be pelletized or briquetted with some of the organic material extracted from the coal with the solvent.

Coal as it comes from the mine is usually subjected to a washing operation, resulting in coal particles having a high degree of surface moisture. This moisture leads to difficulties in handling and shipping. Various methods of dewatering coal have been utilized over the years.

Lignite materials in particular frequently contain a very high amount of moisture. In some cases, the amount of so-called inherent moisture in lignite particles is as high as 65% by weight. At least part of this moisture must be removed in order to obtain efficient burning of the lignite and also to reduce the cost of transporting the material. The present invention solves these and other problems with drying and upgrading of coal, lignite and the like, as will become more apparent hereinafter.

Applicants are not aware of any prior art references which, in their judgment as persons skilled in the coal dewatering art, would anticipate or render obvious the novel solvent dewatering techniques of the instant invention; however, for the purposes of fully developing the background of the invention and establishing the state of the requisite art, the following references are set forth: U.S. Pat. No. 3,327,402 (Lamb et al) and U.S. Pat. No. 4,014,104 (Murphy).

SUMMARY OF THE INVENTION

According to the present invention, a process is provided for drying coal containing water and including fine particles by mixing a nonaqueous solvent with the coal, the solvent having a lower heat of vaporization than the water and being miscible with the water and functioning to extract organics from the coal; applying heat to the coal sufficient to vaporize at least part of the solvent and water substantially free of the extracted organics; recovering the solvent from the vaporized solvent and water and forming the fine coal particles and extracted organics into larger coal particles.

The present invention also pertains to a process for water-proofing coal by mixing a nonaqueous solvent with the coal, the solvent functioning to extract organics from the coal; applying heat to the coal sufficient to vaporize at least part of the solvent which is substantially free of the extracted organics which remain as a coating on the coal, and recovering the solvent.

Even further, the present invention relates to a process for reducing slagging and fouling behavior of coal by extracting minerals therefrom, including mixing a nonaqueous solvent with the coal, the solvent functioning to extract minerals from the coal, and separating the solvent and minerals from the coal.

Also, in accordance with the invention, a process is provided both for drying coal containing water and producing wax and resin from the coal by mixing a nonaqueous solvent with the coal, the solvent having a lower heat of vaporization than the water and being miscible with the water and functioning to extract wax and resin from the coal, separating at least part of the solvent from the coal, the solvent containing wax and resin, and recovering the solvent from the wax and resin, applying heat to the coal to vaporize at least part of the solvent remaining with the coal and at least part of the water, and recovering the solvent from the vaporized solvent and water.

The present invention additionally provides a process for drying coal containing water by mixing either acetone, acetone and water, acetone and naptha, methylethyl ketone, or tetrahydrofuran with the coal, applying heat to the coal sufficient to vaporize at least part of the acetone and water, and recovering the acetone from the vaporized acetone and water.

Finally, the present invention covers a process for reducing oxidation of coal in order to enhance subsequent liquefaction of the coal, including mixing a nonaqueous solvent with the coal, the solvent functioning to extract organics from the coal, applying heat to the coal sufficient to vaporize at least part of the solvent which is substantially free of the extracted organics which remain as a coating on the coal, and subjecting the coal to liquefaction.

Other purposes, advantages and features of the invention will be apparent to one skilled in the art upon review of the following.

DESCRIPTION OF THE PREFERRED EMBODIMENTS

Wet processing methods in coal preparation plants are in widespread use, and high moisture Western coals and lignites are taking an even larger market share, all of which increases the needs for an improved process for removing enough of the moisture to enable efficient handling and shipping of the coals and lignites. Thermal drying currently is required to obtain a moisture content of 3 to 6% by weight for coal particles, where most of the moisture is surface moisture, or about 15 to 18% moisture for lignite particles, where most of the moisture is inherent moisture.

While it is apparent that most of the moisture on coal particles could be removed by thorough washing with a solvent, it is not apparent that many other advantages can be realized in addition to reduced drying time and reduced drying temperature. Thus, in addition to reduced drying costs, other savings are realized by upgrading the coal in other ways. Hence, it is also feasible to improve the dusting, waterproofing and resistance to spontaneous combustion of the product coal. The present invention provides a number of solvents which are suitable for this use. The solvent should have a small latent heat of vaporization relative to water for high thermal efficiency during recovery, low boiling point for ease of solvent recovery, and high water solubility. In addition to removing water, the solvent may also extract waxes and resins which are useful in various ways. Table 1 below contains data on waxes and resins extracted from Jackson lignite taken from core samples of a 6.0 to 7.5-foot seam near Trinity, Tex. A proximate analysis showed as-received properties of 41.7% moisture, 16.9% ash, 24.1% volatiles, 17.4% fixed carbon and a heating residue of 5232 BTU/lb.

TABLE 1

SOLVENT vs. EXTRACT YIELD IN DEWATERING JACKSON SEAM LIGNITE (SOXHLET EXTRACTOR UNTIL CLEAR SOLVENT)

| Solvent | Extract Yield % w Moisture-Free | Extract Yield % w Moisture-Ash-Free |
|---|---|---|
| Tetrahydrofuran (THF) | 8.5 | 12.1 |
| Methyl Ethyl Ketone (MEK) | 6.0 | 8.3 |
| n-Butanol | 5.3 | 6.3 |
| Acetone | 3.0 | 4.4 |
| Isopropyl Alcohol (IPA) | 1.6 | 2.3 |
| Ethanol, 3A Denatured | 3.6 | 4.7 |
| 80v % Acetone | 4.0 | 5.4 |
| 20v % Methanol | | |
| 80v % Ethanol | 6.9 | 9.0 |
| 20v % Benzene | | |
| 80v % Acetone | 4.2 | 5.8 |
| 20v % MEK | | |
| 80v % IPA | 11.2 | 13.8 |
| 20v % Benzene | | |
| 80v % Acetone | 7.0 | 9.2 |
| 20v % Freon II | | |
| 80v % IPA | 7.7 | 10.5 |
| 20v % Petroleum Ether (60–90° C. B.P.) | | |
| 80v % Acetone | 6.2 | 8.1 |
| 20v % Methylene Chloride | | |
| 80v % Acetone | 5.8 | 6.9 |
| 20v % Petroleum Ether (60–90° C. B.P.) | | |

Acetone extracted solids in particular are found to readily briquette without added binder and at ambient temperature. Briquetting pressures are low, for example at about 2600 psig. Briquettes reduce fines volume and the dusting problems in storage and transportation of lignite. Pellets may be made from the fine particles during the solvent recovery process in accordance with the well known pelletizing art. If the solvent containing some of the extracted waxes and resins is evaporated from the lignite in a rotating flask, relatively strong pellets are formed. For Jackson lignite, moisture was reduced from about 42% by weight to a range of 6 to 12% by weight with acetone as the solvent, and residual acetone concentration, after removal of acetone and water from the coal, was about 0.5% to 0.1% by weight.

Dust is efficently washed from the surface of the coal particles by the solvent, preferably in a counter-current operation. Dust consists of micron-sized particles that cling to the coal surface after the screening operation. After the solvent is removed from the dust particles, they are formed into strong briquettes. It is reported that dust causes fires and handling problems when utilizing Western coals. As extract is recycled with fresh solvent, a solid product is made that gives less dusting and water reabsorption.

The solvent dewatering technique of the present invention is also a preferred drying step prior to coal liquefaction processing. Oxidation of coal decreases liquefaction conversion yields and the present process reduces coal oxidation subsequent to drying.

Another advantage of the present invention is that the extracted dewatering process also results in the reduction of sodium and/or potassium in the product solid. Alkaline metal reduction improves the slagging, fouling and/or corrosion characteristics of the ash. Reduced water adsorption for solvent dewatered coal is also realized which can be accomplished by leaving waxes and resins as a coating on the coal subsequent to the solvent removal of water therefrom.

As shown in Table 2 below, another powerful solvent is tetrahydrofuran, which has an extract yield of 12% of a lignite on a moisture and ash-free basis.

TABLE 2

EFFECT OF SOLVENT ON EXTRACT YIELD IN DEWATERING JACKSON SEAM LIGNITE (Soxhlet Extractor until Clear Solvent)

| Solvent | Extract Yield, % w of Lignite Moisture-Free | Extract Yield, % w of Lignite Moisture-Ash-Free |
|---|---|---|
| Tetrahydrofuran (THF) | 8.5 | 12.1 |
| Methyl Ethyl Ketone (MEK) | 6.0 | 8.3 |
| Acetone | 3.0 | 4.4 |
| Isopropyl Alcohol (IPA) | 1.6 | 2.3 |
| 63% v Methylcyclopentane (MCP) | 1.5 | 2.1 |
| 37% v Methanol | | |
| 20% v Petroleum Ether (30–60° C.) | 3.7 | 5.2 |
| 80% v Acetone | | |
| 20% v Synthetic Naptha* (69–82° C.) | 4.8 | 6.8 |
| 80% v Acetone | | |

| SOLVENT | AMOUNT, % v | BP °C. |
|---|---|---|
| Benzene | 25 | 80 |
| MCP | 25 | 72 |
| Cyclohexane | 25 | 83 |
| n-Hexane | 25 | 69 |

*Synthetic Naptha

Various combinations of solvents are also suitable for use with the invention. For example, cutting acetone with a cheaper naptha-type solvent, e.g. up to about 20% by weight of the latter, increases the extract yield over that of pure acetone.

As above noted, some mineral is apparently released from the coal matrix by solvent action. Carbonaceous-free lens of clay are observed in the dried, extracted solids for most of the solvents. A cyclone or other separation device is included either in or following the extraction circuit. Table 3 below shows extract and solids properties following extraction of Jackson lignite with two solvents, acetone and methylethyl ketone. Dried, extracted solids were subjected to a sink/float test in 1.58 sg Freon TM. Methylethyl ketone performed best; extracted solids of 30% w ash were reduced to 23.5%w ash in a 1.58 sg float, which recovered 89.6%w of starting solids or 98.9%w of starting calorific value of extracted solids.

TABLE 3

PROPERTIES OF SOLVENT DEWATERED JACKSON SEAM LIGNITE

| | Solvent Acetone | Solvent MEK |
|---|---|---|
| Extract, % w MF Basis** | 3.01 | 5.97 |
| Extract, % w MAF Basis*** | 4.43 | 8.30 |
| Extracted Solids | 33.11 | 29.81 |
| Ash, % w | | |
| 1.58 sg Float of Extracted Solids | | |
| Yield, % w | 81.6 | 89.6 |
| Ash, % w | 27.9 | 23.5 |
| Total Sulfur, % w | 1.33 | 1.45 |
| Calorific Value, Btu/lb | 8579 | 9054 |
| Float recovery of calorific value of extracted solids,* % | 89.0 | 98.9 |
| 1.58 sg Sink of Extracted Solids | | |
| Yield, % w | 18.4 | 10.4 |
| Ash, % w | 56.5 | 83.7 |

*Calculated assuming Mineral Matter = 1.1 × ash (750° C.)
**Moisture free basis
***Moisture-ash-free basis Accordingly, by practicing the present invention, energy requirements for solvent dewatering are significantly lower than those required for thermal drying; the process runs at atmospheric pressure and modest temperatures; a significant extract yield is produced which has a hydrocarbon ratio similar to most snycrudes, dewatered solids are amenable to further upgrading by simple screening and specific gravity separations; dried solids appear to briquette more easily with certain solvents, and potassium and sodium salts are removed from the lignite in sufficient amount to improve fouling and slagging behavior.

The foregoing description of the invention is merely intended to be explanatory thereof. Various changes in the described apparatus may be made within the scope of the appended claims without departing from the spirit of the invention.

What is claimed is:

1. A process for drying coal containing water and including fine coal particles, comprising, mixing a nonaqueous solvent of acetone and naphtha with the coal, the solvent having a lower heat of vaporization than the water and being miscible with the water and functioning to extract organics from the coal; applying heat to the coal sufficient to vaporize at least part of the solvent and water substantially free of the extracted organics; recovering the solvent from the vaporized solvent and water; and forming the fine coal particles and extracted organics into larger coal particles.

2. The process of claim 1 wherein the extracted organics are waxes and resins.

3. The process of claim 2 wherein the fine coal particles are briquetted or pelletized with waxes and resins.

4. A process for water-proofing coal, comprising, mixing a nonaqueous solvent of acetone containing naphtha with the coal, the solvent functioning to extract organics from the coal; applying heat to the coal sufficient to vaporize at least part of the solvent which is substantially free of the extracted organics which remain as a coating on the coal; and recovering the solvent.

5. The process of claim 4 wherein the extracted organics are waxes and resins.

6. A process for reducing slagging and fouling behavior of coal by extracting minerals therefrom, comprising, mixing a nonaqueous solvent of tetrahydrofuran with the coal, the solvent functioning to extract minerals from the coal, and separating the solvent and minerals from the coal.

7. The process of claim 6 wherein the solvent is evaporated from the coal and the minerals are separated from the coal in a cyclone.

8. The process of claim 6 wherein the minerals are sodium and potassium salts.

9. A process for drying coal containing water and producing wax and resin from the coal, comprising mixing a nonaqueous solvent of acetone containing naphtha with the coal, the solvent having a lower heat of vaporization than the water and being miscible with the water and functioning to extract wax and resin from the coal; separating at least part of the solvent from the coal, the solvent containing wax and resin, and recovering the solvent from the wax and resin; applying heat to the coal to vaporize at least part of the solvent remaining with the coal and to vaporize at least part of the water; and recovering the solvent from the vaporized solvent and water.

10. A process for drying coal containing water, comprising, mixing acetone containing naptha with the coal; applying heat to the coal sufficient to vaporize at least part of the acetone and naptha.

11. A process for drying coal containing water, comprising, mixing tetrahydrofuran with the coal; applying heat to the coal sufficient to vaporize at least part of the tetrahydrofuran and water; and recovering the tetrahydrofuran from the vaporized tetrahydrofuran and water.

12. A process for reducing oxidation of coal in order to enhance subsequent liquefaction of the coal, comprising, mixing a nonaqueous solvent of acetone containing naphtha with the coal, the solvent functioning to extract organics from the coal; applying heat to the coal sufficient to vaporize at least part of the solvent which is substantially free of the extracted organics which remain as a coating on the coal; and subjecting the coal to liquefaction.

13. A process for reducing oxidation of coal in order to enhance subsequent liquefaction of the coal, comprising, mixing a non-aqueous solvent of tetrahydrofuran with the coal, the solvent functioning to extract organics from the coal; applying heat to the coal sufficient to vaporize at least part of the solvent which is substantially free of the extracted organics which remain as a coating on the coal; and subjecting the coal to liquefaction.

14. A process for drying coal containing water and producing wax and resin from the coal, comprising mixing a nonaqueous solvent of tetrahydrofuran with the coal, the solvent having a lower heat of vaporization than the water and being miscible with the water and functioning to extract wax and resin from the coal; separating at least part of the solvent from the coal, the solvent containing wax and resin, and recovering the solvent from the wax and resin; applying heat to the coal to vaporize at least part of the solvent remaining with the coal and to vaporize at least part of the water; and recovering the solvent from the vaporized solvent and water.

* * * * *